US012465079B2

(12) United States Patent
Stuart et al.

(10) Patent No.: US 12,465,079 B2
(45) Date of Patent: Nov. 11, 2025

(54) SMOKING SUBSTITUTE DEVICE

(71) Applicant: Imperial Tobacco Limited

(72) Inventors: Ian Stuart, Liverpool (GB); Matthew Elt, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 521 days.

(21) Appl. No.: 17/842,243

(22) Filed: Jun. 16, 2022

(65) Prior Publication Data

US 2022/0304377 A1 Sep. 29, 2022

Related U.S. Application Data

(63) Continuation of application No. PCT/EP2020/086820, filed on Dec. 17, 2020.

(30) Foreign Application Priority Data

Dec. 18, 2019 (EP) ..... 19217641

(51) Int. Cl.
*A24F 40/40* (2020.01)
*A24F 40/51* (2020.01)

(52) U.S. Cl.
CPC ..... *A24F 40/40* (2020.01); *A24F 40/51* (2020.01)

(58) Field of Classification Search
None
See application file for complete search history.

(56) References Cited

U.S. PATENT DOCUMENTS

| | | | | |
|---|---|---|---|---|
| 12,075,837 | B1 * | 9/2024 | He | A24F 40/10 |
| 2007/0045288 | A1 | 3/2007 | Nelson | |
| 2017/0360090 | A1 * | 12/2017 | Grossfeld | H04M 1/72409 |
| 2019/0166914 | A1 | 6/2019 | Qiu | |

FOREIGN PATENT DOCUMENTS

| | | | | |
|---|---|---|---|---|
| CN | 106072770 | A | 11/2016 | |
| CN | 106235413 | A * | 12/2016 | A24F 47/008 |
| CN | 205831082 | U * | 12/2016 | |
| EP | 2897478 | A0 | 9/2013 | |
| WO | WO2014045025 | A2 | 3/2014 | |
| WO | WO-2017186944 | A1 * | 11/2017 | A24D 1/20 |
| WO | WO-2018014817 | A1 * | 1/2018 | A24F 40/42 |
| WO | WO-2019090200 | A1 * | 5/2019 | A24F 40/53 |
| WO | WO-2019101947 | A1 * | 5/2019 | A24F 40/40 |

OTHER PUBLICATIONS

English machine translation of WO 2018014817 A1 to Qiu; 23 pages; Jan. 25, 2018; A24F40/42. (Year: 2018).*

(Continued)

*Primary Examiner* — Linda L Gray
(74) *Attorney, Agent, or Firm* — DUNLAP CODDING, P.C.

(57) ABSTRACT

Disclosed is a smoking substitute device comprising a body, a heating element projecting from an end of the body, a cap for engagement with the end of the body, the cap defining a cavity for receipt of the heating element when engaged with the body, and a lock configured to selectively prevent disengagement of the cap from the body based on a condition of the heating element.

13 Claims, 7 Drawing Sheets

(56) References Cited

OTHER PUBLICATIONS

English machine translation of WO 2019/101947 to Moloney; 13 pages; May 31, 2019; A24F40/40. (Year: 2019).*
English machine translation of CN 106235413 To Unannounced Inventor; 14 pages; Dec. 21, 2016; A24F47/008. (Year: 2016).*
English machine translation of CN 205831082 to Unannounced Inventor; 6 pages; Dec. 28, 2016. (Year: 2016).*
English machine translation of KR20190027247 to Hwang; 18 pages; Mar. 14, 2019; A24F40/46. (Year: 2019).*
English machine translation of CN 203492793 U to Xiang; 22 pages; Mar. 26, 2014. (Year: 2014).*
European Search Report (19217641.0-1004), dated Jul. 15, 2020, 6 pages.
International Search Report and Written Opinion (PCT/EP2020/086820), dated Mar. 24, 2021, 13 pages.

* cited by examiner

SMOKING SUBSTITUTE DEVICE

CROSS-REFERENCE TO RELATED APPLICATIONS/INCORPORATION BY REFERENCE STATEMENT

This application is a non-provisional application claiming benefit to the international application no. PCT/EP2020/086820 filed on Dec. 17, 2020, which claims priority to EP 19217641.0 filed on Dec. 18, 2019. The entire contents of each of the above-referenced applications are hereby incorporated herein by reference in their entirety.

TECHNICAL FIELD

The present disclosure relates to a smoking substitute device that may form part of a substitute smoking system including the device and an aerosol-forming article.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Conventional combustible smoking articles, such as cigarettes, typically comprise a cylindrical rod of tobacco comprising shreds of tobacco which is surrounded by a wrapper, and usually also a cylindrical filter axially aligned in an abutting relationship with the wrapped tobacco rod. The filter typically comprises a filtration material which is circumscribed by a plug wrap. The wrapped tobacco rod and the filter are joined together by a wrapped band of tipping paper that circumscribes the entire length of the filter and an adjacent portion of the wrapped tobacco rod. A conventional cigarette of this type is used by lighting the end opposite to the filter, and burning the tobacco rod. The smoker receives mainstream smoke into their mouth by drawing on the mouth end or filter end of the cigarette.

Combustion of organic material such as tobacco is known to produce tar and other potentially harmful by-products. There have been proposed various smoking substitute systems (or "substitute smoking systems") in order to avoid the smoking of tobacco.

Such smoking substitute systems can form part of nicotine replacement therapies aimed at people who wish to stop smoking and overcome a dependence on nicotine.

Smoking substitute systems include electronic systems that permit a user to simulate the act of smoking by producing an aerosol (also referred to as a "vapor") that is drawn into the lungs through the mouth (inhaled) and then exhaled. The inhaled aerosol typically bears nicotine and/or flavorings without, or with fewer of, the odor and health risks associated with traditional smoking.

In general, smoking substitute systems are intended to provide a substitute for the rituals of smoking, whilst providing the user with a similar experience and satisfaction to those experienced with traditional smoking and with combustible tobacco products. Some smoking substitute systems use smoking substitute articles (also referred to as a "consumables") that are designed to resemble a traditional cigarette and are cylindrical in form with a mouthpiece at one end.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories.

There are a number of different categories of smoking substitute systems, each utilizing a different smoking substitute approach.

One approach for a smoking substitute system is the so-called Heated Tobacco ("HT") approach in which tobacco (rather than an "e-liquid") is heated or warmed to release vapor. HT is also known as "heat not burn" ("HNB"). The tobacco may be leaf tobacco or reconstituted tobacco. The vapor may contain nicotine and/or flavorings. In the HT approach the intention is that the tobacco is heated but not burned, i.e., the tobacco does not undergo combustion.

A typical HT smoking substitute system may include a device and a consumable. The consumable may include the tobacco material. The device and consumable may be configured to be physically coupled together. In use, heat may be imparted to the tobacco material by a heating element of the device, wherein airflow through the tobacco material causes components in the tobacco material to be released as vapor. A vapor may also be formed from a carrier in the tobacco material (this carrier may for example include propylene glycol and/or vegetable glycerin) and additionally volatile compounds released from the tobacco. The released vapor may be entrained in the airflow drawn through the tobacco.

As the vapor passes through the consumable (entrained in the airflow) from the location of vaporization to an outlet of the consumable (e.g., a mouthpiece), the vapor cools and condenses to form an aerosol for inhalation by the user. The aerosol will normally contain the volatile compounds.

In HT smoking substitute systems, heating as opposed to burning the tobacco material is believed to cause fewer, or smaller quantities, of the more harmful compounds ordinarily produced during smoking. Consequently, the HT approach may reduce the odor and/or health risks that can arise through the burning, combustion and pyrolytic degradation of tobacco.

In order to heat the tobacco material, the heating element of such devices is heated to a temperature that can cause injury (i.e., burns) to a user if the user comes into contact with the heating element. In some devices this is avoided by the provision of the heating element within a barrier (such as a shroud) that prevents contact by a user. This, however, can make it difficult for a user to access the heating element in order to clean it.

There may be a need for improved design of smoking substitute systems, in particular HT smoking substitute systems, to enhance the user experience and improve the function of the HT smoking substitute system.

The present disclosure has been devised in the light of the above considerations.

SUMMARY OF THE DISCLOSURE

At its most general, the present disclosure relates to a smoking substitute device comprising a cap for enclosing a heating element of the device, and a locking mechanism for locking the cap to the device based on a condition of the heating element.

According to a first aspect of the present disclosure, there is provided a smoking substitute device comprising:

a body;

a heating element projecting from an end of the body;

a cap for engagement with the end of the body, the cap defining a cavity for receipt of the heating element when engaged with the body; and a lock configured to selectively prevent disengagement of the cap from the body based on a condition of the heating element.

By providing a lock for locking the cap in response to a condition of the heating element, it may be possible to prevent removal of the cap when it would be unsafe for a user to do so. In other words, the cap may act as a protective barrier and, thus, preventing removal of the cap may prevent a user from touching the heater when it could, e.g., burn the user.

Such an arrangement may mean that the cap can only be disengaged when the heater is in a state that it does not pose a safety risk to a user. Thus, there may be no need to provide a barrier or shroud to protect a user from, e.g., being burnt by the heating element. In this way, the heating element may be more accessible (at least when the cap is removed) for, e.g., cleaning.

Optional features will now be set out. These are applicable singly or in any combination with any aspect.

The lock may be configured to selectively prevent disengagement of the cap from the body based on a temperature of the heating element (i.e., the condition of the heating element may be the temperature of the heating element). Thus, the lock may be configured to prevent disengagement of the cap from the body when the temperature of the heating element is above a predetermined threshold temperature.

The device may comprise a temperature sensor for detecting the temperature of the heating element.

In other embodiments the lock may be configured to selectively prevent disengagement of the cap from the body based on whether the heating element is active (i.e., the condition of the heating element may be whether the heating element is active). The lock may be configured to prevent disengagement of the cap while the heating element is in an active state.

The device may comprise a controller configured to control the state of the lock. The controller may be configured to control the state of the lock between a locked state in which the cap is prevented from being disengaged with the body, and an unlocked state in which the cap is able to be disengaged from the body.

The controller may be configured to compare a temperature signal (indicative of a measured temperature of the heating element) received from the temperature sensor with a predetermined threshold temperature and may control the lock in response to the comparison. The controller may be configured to cause the lock to enter the locked state when the measured temperature exceeds the predetermined threshold temperature. The controller may be configured to cause the lock to enter the unlocked state when the measured temperature is below the predetermined threshold temperature.

The controller may be configured to cause the lock to enter the locked state when the heating element is activated (i.e., when electrical current is being supplied to the heating element). The controller may be configured to cause the lock to enter the unlocked state when the heating element is deactivated (i.e., when no electrical current is being supplied to the heating element).

The lock may form part of the body of the device or may form part of the cap. The lock may engage a retaining portion, which may form part of the other of the body or the device. For example, the retaining portion may comprise an aperture, edge, ledge, protrusion, catch, latch etc. that the lock engages. The retaining portion may be configured to be received in a recess of the device or cap when engaged therewith. The retaining portion may project from an end of the device or cap. This may facilitate locking of the cap to the body by the lock. Thus for example, the lock may be located in the recess of the body or cap (into which the retaining portion is received).

The lock may comprise an electro-mechanical device, such as a solenoid, linear actuator or stepper motor. The electro-mechanical device may be moved (e.g., by the controller) to engage the retaining portion when the lock is in the locked state. As an example, where the lock comprises a solenoid, the solenoid may move a pin through an aperture in the retaining portion of the cap so as to prevent disengagement of the cap from the device.

The lock may comprise a shape memory alloy wire (e.g., a muscle wire actuator). In such embodiments, the wire may be configured to tighten around the retaining portion when in the locked state. In this way, the wire may grip the retaining portion of the cap and prevent disengagement of the cap (e.g., by a user).

The lock may comprise a bimetallic component configured to change shape in response to the temperature of the heating element. In such embodiments, the device may not require a sensor to determine the temperature of the heating element (the bimetallic component may, itself, act as a sensor). The bimetallic heating component may be configured to engage the retaining portion of the cap directly, or may be configured to move an intermediate component (such as a pin) that engages the retaining portion (i.e., when in the locked state).

The lock may comprise an expanding wax mechanism. The expanding wax mechanism may comprise a cavity containing wax and a piston partially enclosing the cavity. The expanding wax mechanism may be configured such that upon heating of the wax (due to the heating element having a temperature above a predetermined threshold temperature), the wax may melt so as to cause the piston to move. The piston may, when moved, directly engage the retaining portion, or may be configured to move an intermediate component (such as a pin) that engages the retaining portion.

The lock may be configured to provide a retaining force of 50N to 130N (i.e., the force required to disengage the cap from the body when in the locked state). The lock may be configured to provide a retaining force of 80N to 100N. The lock may be configured to provide a retaining force of about 90N.

The cap may comprise an outer portion for gripping by a user, and an inner portion at least partly enclosing the heating element. The cap may be configured such that a force to disengage the cap from the body, when in the locked state, is greater than a force to separate the outer portion from the inner portion of the cap. In this way, if a user attempts to remove the cap (with force) when the lock is in the locked state, the outer portion of the cap will break away from the inner portion of the cap rather than the entire cap being disengaged from the body. Because the inner portion at least partly encloses the heating element, the user will remain protected from the heating element when this occurs.

The device may be configured to detect when the outer portion of the cap is separated from the inner portion of the cap (i.e., or disengaged from the body). Thus, for example, the device may comprise a tamper sensor for detecting whether the outer portion of the cap has been separated from the inner portion. The sensor may be in the form of a hall sensor, and the outer portion of the cap may comprise a magnet detectable by the hall sensor. The hall sensor may form part of the body or the inner portion of the cap. Thus, when the outer portion is separated from the inner portion, the hall sensor will no longer detect the magnet, which will be indicative of the separation of the two portions.

The controller may be configured to receive a tamper signal from the tamper sensor that is indicative of the outer portion having been separated from the inner portion. The controller may be configured, in response to receipt of the signal, deactivate the heating element (i.e., prevent power supply to the heating element). Thus, separation of the outer portion from the inner portion may result in the heating element being deactivated.

The outer portion of the cap may be connected to the inner portion of the cap by a weakened portion (i.e., ensuring separation of the outer portion from the inner portion instead of disengagement of the cap from the body when in the locked state). The weakened portion may, e.g., be a thinner portion (e.g., line) of material connecting the outer and inner portions of the cap. The weakened portion may be a frangible portion.

The weakened portion may be configured to separate (e.g., break) at a force that is less than 80N (e.g., less than 60N).

The lock or retaining portion may form part of or be connected to the inner portion of the cap. That is, the cap may be locked to the device via the inner portion (rather than the outer portion).

The cap may be releasably engageable with the body, e.g., by way of a snap-engagement mechanism. Thus, one of the device or the cap may comprise a recess (or aperture, edge, ledge, etc.) and other of the cap or the device may comprise a protrusion for engagement with the recess. In this way, the cap can be releasably engaged with the device and, subsequently, the lock can enter a locked state to prevent disengagement.

Alternatively, or additionally, the cap may be releasably engageable with the body by way of a magnetic connection. Thus, for example, the body or cap may comprise one or more magnets and the other of the body or cap may comprise one or more ferrous elements positioned to interact with the magnets. The magnets may also be configured to align the cap on the body.

The cap may comprise an aperture for receipt of the heating element into the cavity (when the cap is engaged with the body). The cap may comprise an opening to the cavity, into which at least a portion of an aerosol-forming article may be received. That is, an aerosol-forming article may be inserted through the opening and into the cavity (so as to be engaged with the device and so as to be heated by the heating element located in the cavity).

The cap may be configured such that when an aerosol-forming article is engaged with the device (e.g., received in the cavity), only a portion of the aerosol-forming article is received in the cavity. That is, a portion of the aerosol-forming article (not received in the cavity) may protrude from (i.e., extend beyond) the opening. This (protruding) portion of the aerosol-forming article may be a terminal (e.g., mouth) end of the aerosol-forming article, which may be received in a user's mouth for the purpose of inhaling aerosol formed by the device.

The body of the device may be elongate. An end of the elongate body, at which the heating element projects and the cap is engaged, may be configured for engagement with an aerosol-forming article. For example, the body may be configured for engagement with a heated tobacco (HT) consumable (or heat-not-burn (HNB) consumable). The terms "heated tobacco" and "heat-not-burn" are used interchangeably herein to describe a consumable that is of the type that is heated rather than combusted (or are used interchangeably to describe a device for use with such a consumable). The device may comprise a cavity that is configured for receipt of at least a portion of the consumable (i.e., for engagement with the consumable). As will be described further below, the cavity may be defined by the cap of the device. The aerosol-forming article may be of the type that comprises an aerosol former (e.g., carried by an aerosol-forming substrate).

The heating element may be in the form of a rod that extends from the body of the device. The heating element may be rigidly mounted to the body. The heating element may be elongate so as to define a longitudinal axis and may, for example, have a transverse profile (i.e., transverse to a longitudinal axis of the heating element) that is substantially circular (i.e., the heating element may be generally cylindrical). Alternatively, the heating element may have a transverse profile that is rectangular (i.e., the heater may be a "blade heater"). The heating element may alternatively be in the shape of a tube (i.e., the heater may be a "tube heater"). The heating element may take other forms (e.g., the heating element may have an elliptical transverse profile). The shape and/or size (e.g., diameter) of the transverse profile of the heating element may be generally consistent for the entire length (or substantially the entire length) of the heating element.

The heating element may be between 15 mm and 25 mm long, e.g., between 18 mm and 20 mm long, e.g., around 19 mm long. The heating element may have a diameter of between 1.5 mm and 2.5 mm, e.g., a diameter between 2 mm and 2.3 mm, e.g., a diameter of around 2.15 mm.

The heating element may be formed of ceramic. The heating element may comprise a core (e.g., a ceramic core) comprising $Al_2O_3$. The core of the heating element may have a diameter of 1.8 mm to 2.1 mm, e.g., between 1.9 mm and 2 mm. The heating element may comprise an outer layer (e.g., an outer ceramic layer) comprising $Al_2O_3$. The thickness of the outer layer may be between 160 μm and 220 μm, e.g., between 170 μm and 190 μm, e.g., around 180 μm. The heating element may comprise a heating track, which may extend longitudinally along the heating element. The heating track may be sandwiched between the outer layer and the core of the heating element. The heating track may comprise tungsten and/or rhenium. The heating track may have a thickness of around 20 μm.

The heating element may be located in the cavity (defined by the cap), and may extend (e.g., along a longitudinal axis) from an internal base of the cavity towards an opening of the cavity. The length of the heating element (i.e., along the longitudinal axis of the heater) may be less than the depth of the cavity. Hence, the heating element may extend for only a portion of the length of the cavity. That is, the heating element may not extend through (or beyond) the opening of the cavity.

The heating element may be configured for insertion into an aerosol-forming article (e.g., a HT consumable) when an aerosol-forming article is received in the cavity. In that respect, a distal end (i.e., distal from a base of the heating element where it is mounted to the device) of the heating element may comprise a tapered portion, which may facilitate insertion of the heating element into the aerosol-forming article. The heating element may fully penetrate an aerosol-forming article when the aerosol-forming article is received in the cavity. That is, the entire length, or substantially the entire length, of the heating element may be received in the aerosol-forming article.

The heating element may have a length that is less than, or substantially the same as, an axial length of an aerosol-forming substrate forming part of an aerosol-forming article (e.g., a HT consumable). Thus, when such an aerosol-forming article is engaged with the device, the heating element may only penetrate the aerosol-forming substrate, rather than other components of the aerosol-forming article. The heating element may penetrate the aerosol-forming substrate for substantially the entire axial length of the aerosol forming-substrate of the aerosol-forming article. Thus, heat may be transferred from (e.g., an outer circumferential surface of) the heating element to the surrounding aerosol-forming substrate, when penetrated by the heating element. That is, heat may be transferred radially outwardly (in the case of a cylindrical heating element) or, e.g., radially inwardly (in the case of a tube heater).

Where the heater is a tube heater, the heating element of the tube heater may surround at least a portion of the cavity. When the portion of the aerosol-forming article is received in the cavity, the heating element may surround a portion of the aerosol-forming article (i.e., so as to heat that portion of the aerosol-forming article). In particular, the heating element may surround an aerosol forming substrate of the aerosol-forming article. That is, when an aerosol-forming article is engaged with the device, the aerosol forming substrate of the aerosol-forming article may be located adjacent an inner surface of the (tubular) heating element. When the heating element is activated, heat may be transferred radially inwardly from the inner surface of the heating element to heat the aerosol forming substrate.

The device may comprise a power source or may be connectable to a power source (e.g., a power source separate to the device). The power source may be electrically connectable to the heating element. In that respect, altering (e.g., toggling) the electrical connection of the power source to the heating element may affect a state of the heating element. For example, toggling the electrical connection of the power source to the heating element may toggle the heater between an active state and an inactive state. The power source may be a power store. For example, the power source may be a battery or rechargeable battery (e.g., a lithium-ion battery).

The device may comprise an input connection (e.g., a USB port, Micro USB port, USB-C port, etc.). The input connection may be configured for connection to an external source of electrical power, such as a mains electrical supply outlet. The input connection may, in some cases, be used as a substitute for an internal power source (e.g., battery or rechargeable battery). That is, the input connection may be electrically connectable to the heater (for providing power to the heater). Hence, in some forms, the input connection may form at least part of the power source of the device.

Where the power source comprises a rechargeable power source (such as a rechargeable battery), the input connection may be used to charge and recharge the power source.

The device may comprise a user interface (UI). In some embodiments the UI may include input means to receive operative commands from the user. The input means of the UI may allow the user to control at least one aspect of the operation of the device. In some embodiments the input means may comprise a power button to switch the device between an on state and an off state.

In some embodiments the UI may additionally or alternatively comprise output means to convey information to the user. In some embodiments the output means may comprise a light to indicate a condition of the device (and/or the aerosol-forming article) to the user. The condition of the device (and/or aerosol-forming article) indicated to the user may comprise a condition indicative of the operation of the heating element. For example, the condition may comprise whether the heater is in an inactive state or an active state. In some embodiments, the UI unit may comprise at least one of a button, a display, a touchscreen, a switch, a light, and the like. For example, the output means may comprise one or more (e.g., two, three, four, etc.) light-emitting diodes ("LEDs") that may be located on the body of the device.

The device may further comprise a puff sensor (e.g., airflow sensor), which may form part of the input means of the UI. The puff sensor may be configured to detect a user drawing on an end (i.e., a terminal (mouth) end) of the aerosol-forming article. The puff sensor may, for example, be a pressure sensor or a microphone. The puff sensor may be configured to produce a signal indicative of a puff state. The signal may be indicative of the user drawing (an aerosol from the aerosol-forming article) such that it is, e.g., in the form of a binary signal. Alternatively, or additionally, the signal may be indicative of a characteristic of the draw (e.g., a flow rate of the draw, length of time of the draw, etc.).

As is provided above, the device may comprise a controller that may be configured to control at least one function of the device. The controller may comprise a microcontroller that may, e.g., be mounted on a printed circuit board (PCB). The controller may also comprise a memory, e.g., non-volatile memory. The memory may include instructions, which, when implemented, may cause the controller to perform certain tasks or steps of a method. Where the device comprises an input connection, the controller may be connected to the input connection.

The controller may be configured to control the operation of the heating element. Thus, the controller may be configured to control vaporization of an aerosol forming part of an aerosol-forming article engaged with the device. The controller may be configured to control the voltage applied by power source to the heating element. For example, the controller may be configured to toggle between applying a full output voltage (of the power source) to the heating element and applying no voltage to the heating element. Alternatively, or additionally, the control unit may implement a more complex heater control protocol.

The device may further comprise a voltage regulator to regulate the output voltage supplied by the power source to form a regulated voltage. The regulated voltage may subsequently be applied to the heater.

In some embodiments, where the device comprises a UI, the controller may be operatively connected to one or more components of the UI. The controller may be configured to receive command signals from an input means of the UI. The controller may be configured to control the heating element in response to the command signals. For example, the controller may be configured to receive "on" and "off" command signals from the UI and, in response, may control the heating element so as to be in a corresponding active or inactive state.

The controller may be configured to send output signals to a component of the UI. The UI may be configured to convey information to a user, via an output means, in response to such output signals (received from the controller). For example, where the device comprises one or more LEDs, the LEDs may be operatively connected to the controller. Hence, the controller may be configured to control the illumination of the LEDs (e.g., in response to an output signal). For example, the controller may be configured to control the illumination of the LEDs according to (e.g., an on or off) state of the heating element.

The controller may be configured to send an output signal to the UI that is indicative of a state of the lock. In this way, the UI may indicate to a user whether the lock is in a locked or unlocked state. The controller may be configured to send this signal in response to receiving an input signal indicative of interaction from a user (e.g., such as a button press).

Where the device comprises a sensor (e.g., a puff/airflow sensor, tamper sensor), the controller may be operatively connected to the sensor. The controller may be configured to receive a signal from the sensor (e.g., indicative of a condition of the device and/or engaged aerosol-forming article). The controller may be configured to control the heater, or an aspect of the output means, based on the signal from the sensor.

The device may comprise a wireless interface configured to communicate wirelessly (e.g., via Bluetooth (e.g., a Bluetooth low-energy connection) or WIFI) with an external device. Similarly, the input connection may be configured for wired connection to an external device so as to provide communication between the device and the external device.

The external device may be a mobile device. For example, the external device may be a smart phone, tablet, smart watch, or smart car. An application (e.g., app) may be installed on the external device (e.g., mobile device). The application may facilitate communication between the device and the external device via the wired or wireless connection.

The wireless or wired interface may be configured to transfer signals between the external device and the controller of the device. In this respect, the controller may control an aspect of the device in response to a signal received from an external device. Alternatively, or additionally, an external device may respond to a signal received from the device (e.g., from the controller of the device).

In a second aspect, there is provided a smoking substitute device comprising:

a body;

a heating element disposed at an end of the body;

a cap for engagement with the end of the body, the cap comprising an outer portion for gripping by a user and an inner portion for at least partly enclosing the heating element; and a lock configured to selectively prevent disengagement of the cap from the body based on a condition of the heating element;

wherein the cap is configured such that a force to disengage the cap from the body when locked to the body by the lock is greater than a force to separate the outer portion from the inner portion of the cap.

The device of the second aspect may otherwise be as described above with respect to the first aspect.

In a third aspect, there is provided a system (e.g., a smoking substitute system) comprising a device according to the first or second aspect and an aerosol-forming article. The aerosol-forming article may comprise an aerosol-forming substrate at an upstream end of the aerosol-forming article. The article may be in the form of a smoking substitute article, e.g., heated tobacco (HT) consumable (also known as a heat-not-burn (HNB) consumable).

As used herein, the terms "upstream" and "downstream" are intended to refer to the flow direction of the vapor/aerosol, i.e., with the downstream end of the article/consumable being the mouth end or outlet where the aerosol exits the consumable for inhalation by the user. The upstream end of the article/consumable is the opposing end to the downstream end.

The aerosol-forming substrate is capable of being heated to release at least one volatile compound that can form an aerosol. The aerosol-forming substrate may be located at the upstream end of the article/consumable.

In order to generate an aerosol, the aerosol-forming substrate comprises at least one volatile compound that is intended to be vaporized/aerosolized and that may provide the user with a recreational and/or medicinal effect when inhaled. Suitable chemical and/or physiologically active volatile compounds include the group consisting of: nicotine, cocaine, caffeine, opiates and opioids, cathine and cathinone, kavalactones, mysticin, beta-carboline alkaloids, salvinorin A together with any combinations, functional equivalents to, and/or synthetic alternatives of the foregoing.

The aerosol-forming substrate may comprise plant material. The plant material may comprise least one plant material selected from the list including *Amaranthus dubius, Arctostaphylos uva-ursi* (Bearberry), *Argemone mexicana, Amica, Artemisia vulgaris*, Yellow Tees, *Galea zacatechichi, Canavalia maritima* (Baybean), *Cecropia mexicana* (Guamura), *Cestrum noctumum, Cynoglossum virginianum* (wild comfrey), *Cytisus scoparius, Damiana, Entada rheedii, Eschscholzia californica* (California Poppy), *Fittonia albivenis, Hippobroma longiflora, Humulus japonica* (Japanese Hops), *Humulus lupulus* (Hops), *Lactuca virosa* (Lettuce Opium), Laggera *alata, Leonotis leonurus, Leonurus cardiaca* (Motherwort), *Leonurus sibiricus* (Honeyweed), *Lobelia cardinalis, Lobelia inflata* (Indian-tobacco), *Lobelia siphilitica, Nepeta cataria* (Catnip), *Nicotiana* species (Tobacco), *Nymphaea alba* (White Lily), *Nymphaea caerulea* (Blue Lily), Opium poppy, *Passiflora incarnata* (Passionflower), *Pedicularis densiflora* (Indian Warrior), *Pedicularis groenlandica* (Elephant's Head), *Salvia divinorum, Salvia dorrii* (Tobacco Sage), *Salvia* species (Sage), *Scutellaria galericulata, Scutellaria lateriflora, Scutellaria nana, Scutellaria* species (Skullcap), *Sida acuta* (Wireweed), *Sida rhombifolia, Silene capensis, Syzygium aromaticum* (Clove), *Tagetes lucida* (Mexican Tarragon), *Tarchonanthus camphoratus, Tumera diffusa* (*Damiana*), *Verbascum* (Mullein), *Zamia latifolia* (Maconha Brava) together with any combinations, functional equivalents to, and/or synthetic alternatives of the foregoing.

The plant material may be tobacco. Any type of tobacco may be used. This includes, but is not limited to, flue-cured tobacco, burley tobacco, Maryland Tobacco, dark-air cured tobacco, oriental tobacco, dark-fired tobacco, perique tobacco and rustica tobacco. This also includes blends of the above-mentioned tobaccos.

The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon).

The aerosol-forming substrate may comprise a gathered sheet of homogenized (e.g., paper/slurry recon) tobacco or gathered shreds/strips formed from such a sheet.

The aerosol-forming substrate may comprise one or more additives selected from humectants, flavorants, fillers, aqueous/non-aqueous solvents and binders.

The flavorant may be provided in solid or liquid form. It may include menthol, licorice, chocolate, fruit flavor (including, e.g., citrus, cherry etc.), vanilla, spice (e.g., ginger, cinnamon) and tobacco flavor. The flavorant may be evenly dispersed throughout the aerosol-forming substrate or may be provided in isolated locations and/or varying concentrations throughout the aerosol-forming substrate.

The aerosol-forming substrate may be formed in a substantially cylindrical shape such that the article/consumable resembles a conventional cigarette. It may have a diameter of between 5 and 10 mm, e.g., between 6 and 9 mm or 6 and 8 mm, e.g., around 7 mm. It may have an axial length of between 10 and 15 mm, e.g., between 11 and 14 mm such as around 12 or 13 mm.

The article/consumable may comprise at least one filter element. There may be a terminal filter element at the downstream/mouth end of the article/consumable.

The or at least one of the filter element(s) (e.g., the terminal filter element) may be comprised of cellulose acetate or polypropylene tow. The at least one filter element (e.g., the terminal filter element) may be comprised of activated charcoal. The at least one filter element (e.g., the terminal element) may be comprised of paper. The or each filter element may be at least partly (e.g., entirely) circumscribed with a plug wrap, e.g., a paper plug wrap.

The terminal filter element (at the downstream end of the article/consumable) may be joined to the upstream elements forming the article/consumable by a circumscribing tipping layer, e.g., a tipping paper layer. The tipping paper may have an axial length longer than the axial length of the terminal filter element such that the tipping paper completely circumscribes the terminal filter element plus the wrapping layer surrounding any adjacent upstream element.

In some embodiments, the article/consumable may comprise an aerosol-cooling element which is adapted to cool the aerosol generated from the aerosol-forming substrate (by heat exchange) before being inhaled by the user.

The article/consumable may comprise a spacer element that defines a space or cavity between the aerosol-forming substrate and the downstream end of the consumable. The spacer element may comprise a cardboard tube. The spacer element may be circumscribed by the (paper) wrapping layer.

According to a fourth aspect of the present disclosure, there is provided a method of using the system according to the third aspect, the method comprising inserting the aerosol-forming article into the device; and heating the article using the heater of the device.

In some embodiments the method may comprise inserting the article into a cavity within a body of the device and penetrating the article with the heating element of the device upon insertion of the article.

According to a fifth aspect of the present disclosure, there is provided a method of controlling a device according to the first or second aspects, the method comprising:

measuring a temperature of the heating element;

comparing the measured temperature to a predetermined threshold temperature; and controlling the lock to enter a locked state if the measured temperature exceeds the threshold temperature.

According to a sixth aspect of the present disclosure, there is provided a method of controlling a smoking substitute device, the method comprising: using the smoking substitute device to generate an aerosol including engaging a cap with a body wherein the cap defines a cavity with an opening for receiving an aerosol-forming article; measuring a temperature of a heating element arranged within the cavity and for heating the aerosol-forming article; comparing the measured temperature to a predetermined threshold temperature; and controlling a lock to enter a locked state to prevent disengagement of the cap from the body if the measured temperature exceeds the threshold temperature.

The disclosure includes the combination of the aspects and preferred features described except where such a combination is clearly impermissible or expressly avoided.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

SUMMARY OF THE FIGURES

So that the disclosure may be understood, and so that further aspects and features thereof may be appreciated, embodiments illustrating the principles of the disclosure will now be discussed in further detail with reference to the accompanying figures, in which.

DETAILED DESCRIPTION OF THE DISCLOSURE

Aspects and embodiments of the present disclosure will now be discussed with reference to the accompanying figures. Further aspects and embodiments will be apparent to those skilled in the art. All documents mentioned in this text are incorporated herein by reference.

Figure 1:
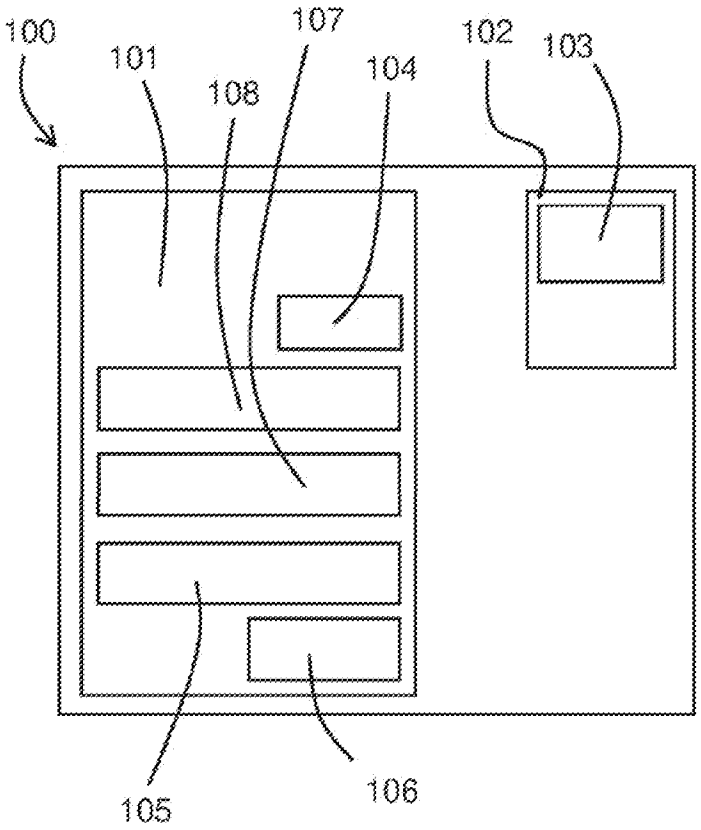
FIG. 1 is a schematic of a smoking substitute system.

FIG. 1 is a schematic providing a general overview of a smoking substitute system 100. The system 100 includes a substitute smoking device 101 and an aerosol-forming article in the form of a consumable 102, which comprises an aerosol former 103. The system is configured to vaporize the aerosol former by heating the aerosol former 103 (so as to form a vapor/aerosol for inhalation by a user).

The system 100 comprises a heater 104, which forms part of the device 101 and is configured to heat the aerosol former 103 when the consumable 102 is engaged with the device 101. Heat from the heater 104 vaporizes the aerosol former 103 to produce a vapor. The vapor subsequently condenses to form an aerosol, which is ultimately inhaled by the user.

The system further comprises a power source 105 that forms part of the device 101. In other embodiments the power source 105 may be external to (but connectable to) the device 101. The power source 105 is electrically connected to the heater 104 such that it is able to supply power to the heater 104 (i.e., for the purpose of heating the aerosol former 103). Thus, control of the electrical connection of the power source 105 to the heater 104 provides control of the state of the heater 104 (e.g., between an active state and an inactive state). The power source 105 may be a power store, for example a battery or rechargeable battery (e.g., a lithium-ion battery).

The system 100 further comprises an I/O module comprising a connector 106 (e.g., in the form of a USB port, Micro USB port, USB-C port, etc.). The connector 106 is configured for connection to an external source of electrical power, e.g., a mains electrical supply outlet. The connector 106 may be used in substitution for the power source 105. That is the connector 106 may be electrically connectable to the heater 104 so as to supply electricity to the heater 104. In such embodiments, the device may not include a power source, and the power source of the system may instead comprise the connector 106 and an external source of electrical power (to which the connector 106 provides electrical connection).

In some embodiments, the connector 106 may be used to charge and recharge the power source 105 where the power source 105 includes a rechargeable battery.

The system 100 also comprises a user interface (UI) 107. Although not shown, the UI 107 may include input means to receive commands from a user. The input means of the UI 107 allows the user to control at least one aspect of the operation of the system 100. The input means may, for example, be in the form of a button, touchscreen, switch, microphone, etc.

The UI 107 also comprises output means to convey information to the user. The output means may, for example, comprise lights (e.g., LEDs), a display screen, speaker, vibration generator, etc.

The system 100 further comprises a controller 108 that is configured to control at least one function of the device 101. In the illustrated embodiment, the controller 108 is a component of the device 101, but in other embodiments may be separate from (but connectable to) the device 101. The controller 108 is configured to control the operation of the heater 104 and, for example, may be configured to control the voltage applied from the power source 105 to the heater 104. The controller 108 may be configured to toggle the supply of power to the heater 104 between an on state, in which the full output voltage of the power source 105 is applied to the heater 104, and an off state, in which the no voltage is applied to the heater 104.

Although not shown, the system 100 may also comprise a voltage regulator to regulate the output voltage from the power source 105 to form a regulated voltage. The regulated voltage may then be applied to the heater 104.

In addition to being connected to the heater 104, the controller 108 is operatively connected to the UI 107. Thus, the controller 108 may receive an input signal from the input means of the UI 107. Similarly, the controller 108 may transmit output signals to the UI 107. In response, the output means of the UI 107 may convey information, based on the output signals, to a user. The controller 108 also comprises a memory 109, which is a non-volatile memory. The memory 109 includes instructions, which, when implemented, cause the controller to perform certain tasks or steps of a method.

Figure 2A:
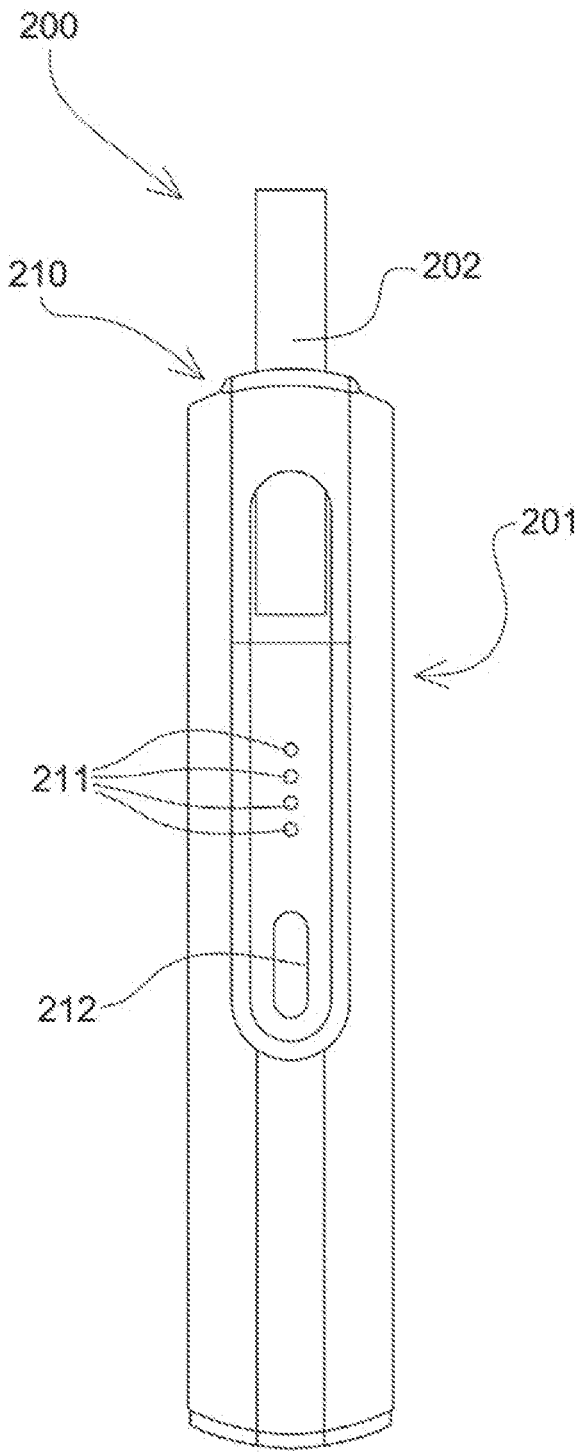
FIG. 2A is a front view of a first embodiment of a smoking substitute system with the consumable engaged with the device.
Figure 2B:
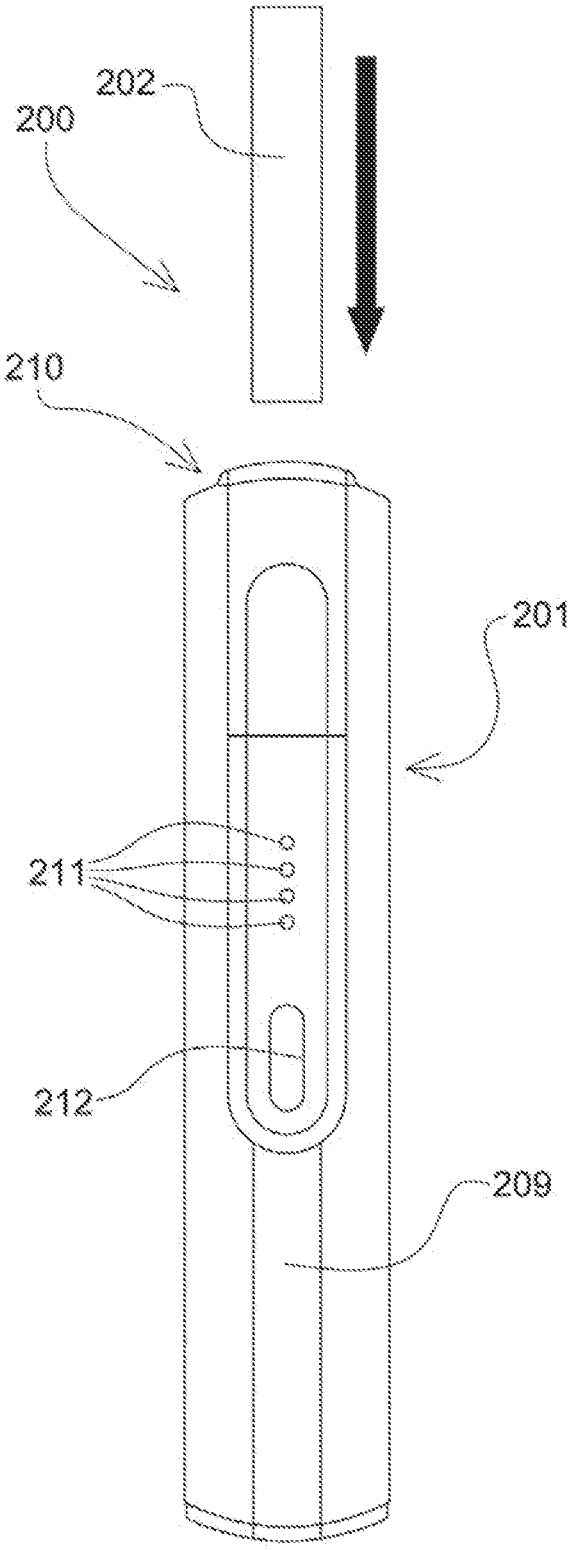
FIG. 2B is a front view of the first embodiment of the smoking substitute system with the consumable disengaged from the device.

FIGS. 2A and 2B illustrate a heated-tobacco (HT) smoking substitute system 200. The system 200 is an example of the system 100 described in relation to FIG. 1. System 200 includes an HT device 201 and an HT consumable 202. The description of FIG. 1 above is applicable to the system 200 of FIGS. 2A and 2B, and will thus not be repeated.

The device 201 and the consumable 202 are configured such that the consumable 202 can be engaged with the device 201. FIG. 2A shows the device 201 and the consumable 202 in an engaged state, whilst FIG. 2B shows the device 201 and the consumable 202 in a disengaged state.

The device 201 comprises a body 209 and cap 210. In use the cap 210 is engaged at an end of the body 209.

The device 201 comprises an output means (forming part of the UI of the device 201) in the form of a plurality of light-emitting diodes (LEDs) 211 arranged linearly along the longitudinal axis of the device 201 and on an outer surface of the body 209 of the device 201. A button 212 is also arranged on an outer surface of the body 209 of the device 201 and is axially spaced (i.e., along the longitudinal axis) from the plurality of LEDs 211.

Figure 2C:
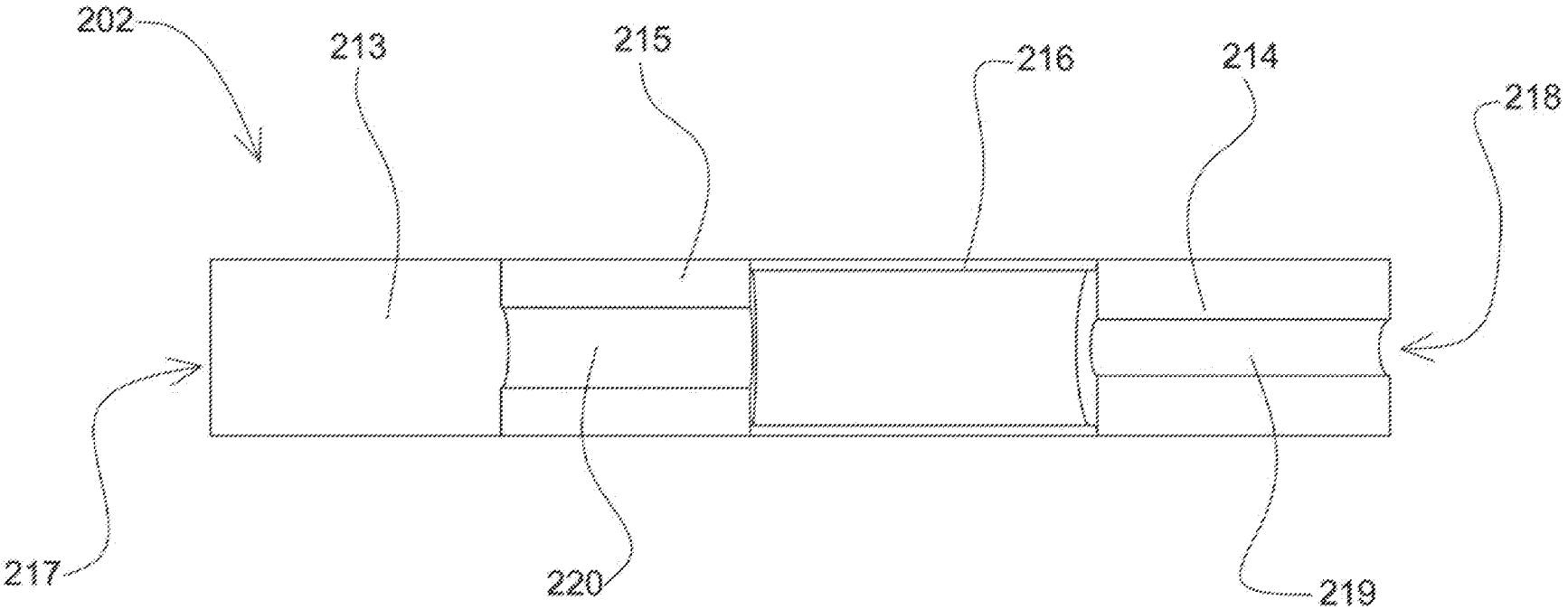
FIG. 2C is a section view of the consumable of the first embodiment of the smoking substitute system.

FIG. 2C show a detailed section view of the consumable of 202 of the system 200. The consumable 202 generally resembles a cigarette. In that respect, the consumable 202 has a generally cylindrical form with a diameter of 7 mm and an axial length of 70 mm. The consumable 202 comprises an aerosol forming substrate 213, a terminal filter element 214, an upstream filter element 215 and a spacer element 216. In other embodiments, the consumable may further comprise a cooling element. A cooling element may exchange heat with vapor that is formed by the aerosol-forming substrate 213 in order to cool the vapor so as to facilitate condensation of the vapor.

The aerosol-forming substrate 213 is substantially cylindrical and is located at an upstream end 217 of the consumable 202, and comprises the aerosol former of the system 200. In that respect, the aerosol forming substrate 213 is configured to be heated by the device 201 to release a vapor. The released vapor is subsequently entrained in an airflow flowing through the aerosol-forming substrate 213. The airflow is produced by the action of the user drawing on a downstream 218 (i.e., terminal or mouth) end of the consumable 202.

In the present embodiment, the aerosol forming substrate 213 comprises tobacco material that may, for example, include any suitable parts of the tobacco plant (e.g., leaves, stems, roots, bark, seeds and flowers). The tobacco may comprise one or more of leaf tobacco, stem tobacco, tobacco powder, tobacco dust, tobacco derivatives, expanded tobacco, homogenized tobacco, shredded tobacco, extruded tobacco, cut rag tobacco and/or reconstituted tobacco (e.g., slurry recon or paper recon). For example, the aerosol-forming substrate 213 may comprise a gathered sheet of homogenized (e.g., paper/slurry recon) tobacco or gathered shreds/strips formed from such a sheet.

In order to generate an aerosol, the aerosol forming substrate 213 comprises at least one volatile compound that is intended to be vaporized/aerosolized and that may provide the user with a recreational and/or medicinal effect when inhaled. The aerosol-forming substrate 213 may further comprise one or more additives. For example, such additives may be in the form of humectants (e.g., propylene glycol and/or vegetable glycerin), flavorants, fillers, aqueous/non-aqueous solvents and/or binders.

The terminal filter element 214 is also substantially cylindrical, and is located downstream of the aerosol forming substrate 213 at the downstream end 218 of the consumable 202. The terminal filter element 214 is in the form of a hollow bore filter element having a bore 219 (e.g., for airflow) formed therethrough. The diameter of the bore 219 is 2 mm. The terminal filter element 214 is formed of a porous (e.g., monoacetate) filter material. As set forth above, the downstream end 218 of the consumable 202 (i.e., where the terminal filter 214 is located) forms a mouthpiece portion of the consumable 202 upon which the user draws. Airflow is drawn from the upstream end 217, thorough the components of the consumable 202, and out of the downstream end 218. The airflow is driven by the user drawing on the downstream end 218 (i.e., the mouthpiece portion) of the consumable 202.

The upstream filter element 215 is located axially adjacent to the aerosol-forming substrate 213, between the aerosol-forming substrate 213 and the terminal filter element 214. Like the terminal filter 214, the upstream filter element 215 is in the form of a hollow bore filter element, such that it has a bore 220 extending axially therethrough. In this way, the upstream filter 215 may act as an airflow restrictor. The upstream filter element 215 is formed of a porous (e.g., monoacetate) filter material. The bore 220 of the upstream filter element 215 has a larger diameter (3 mm) than the terminal filter element 214.

The spacer 216 is in the form of a cardboard tube, which defines a cavity or chamber between the upstream filter element 215 and the terminal filter element 214. The spacer 216 acts to allow both cooling and mixing of the vapor/aerosol from the aerosol-forming substrate 213. The spacer has an external diameter of 7 mm and an axial length of 14 mm.

Although not apparent from the figure, the aerosol-forming substrate 213, upstream filter 215 and spacer 216 are circumscribed by a paper wrapping layer. The terminal filter 214 is circumscribed by a tipping layer that also circumscribes a portion of the paper wrapping layer (so as to connect the terminal filter 214 to the remaining components of the consumable 202). The upstream filter 215 and terminal filter 214 are circumscribed by further wrapping layers in the form of plug wraps.

Figure 2D:
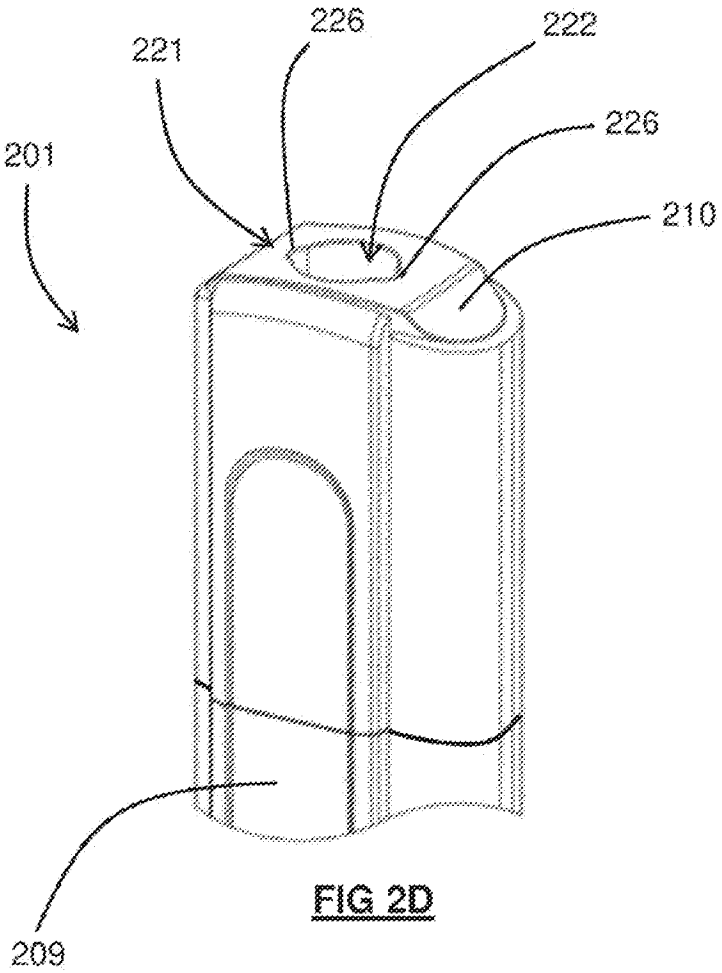
FIG. 2D is a detailed view of an end of the device of the first embodiment of the smoking substitute system.

Returning now to the device 201, FIG. 2D illustrates a detailed view of the end of the device 201 that is configured to engage with the consumable 202. The cap 210 of the device 201 includes an opening 221 to an internal cavity 222 (more apparent from FIG. 2D) defined by the cap 210. The opening 221 and the cavity 222 are formed so as to receive at least a portion of the consumable 202. During engagement of the consumable 202 with the device 201, a portion of the consumable 202 is received through the opening 221 and into the cavity 222. After engagement (see FIG. 2B), the downstream end 218 of the consumable 202 protrudes from the opening 221 and thus also protrudes from the device 201. The opening 221 includes laterally disposed notches 226. When a consumable 202 is received in the opening 221, these notches 226 remain open and could, for example, be used for retaining a cover in order to cover the end of the device 201.

Although not apparent from the figures, the cap 210 is releasably engaged with the device 201 via a snap engagement mechanism. Thus, the cap 210 is removable, for example, for cleaning the device 201.

Figure 2E:
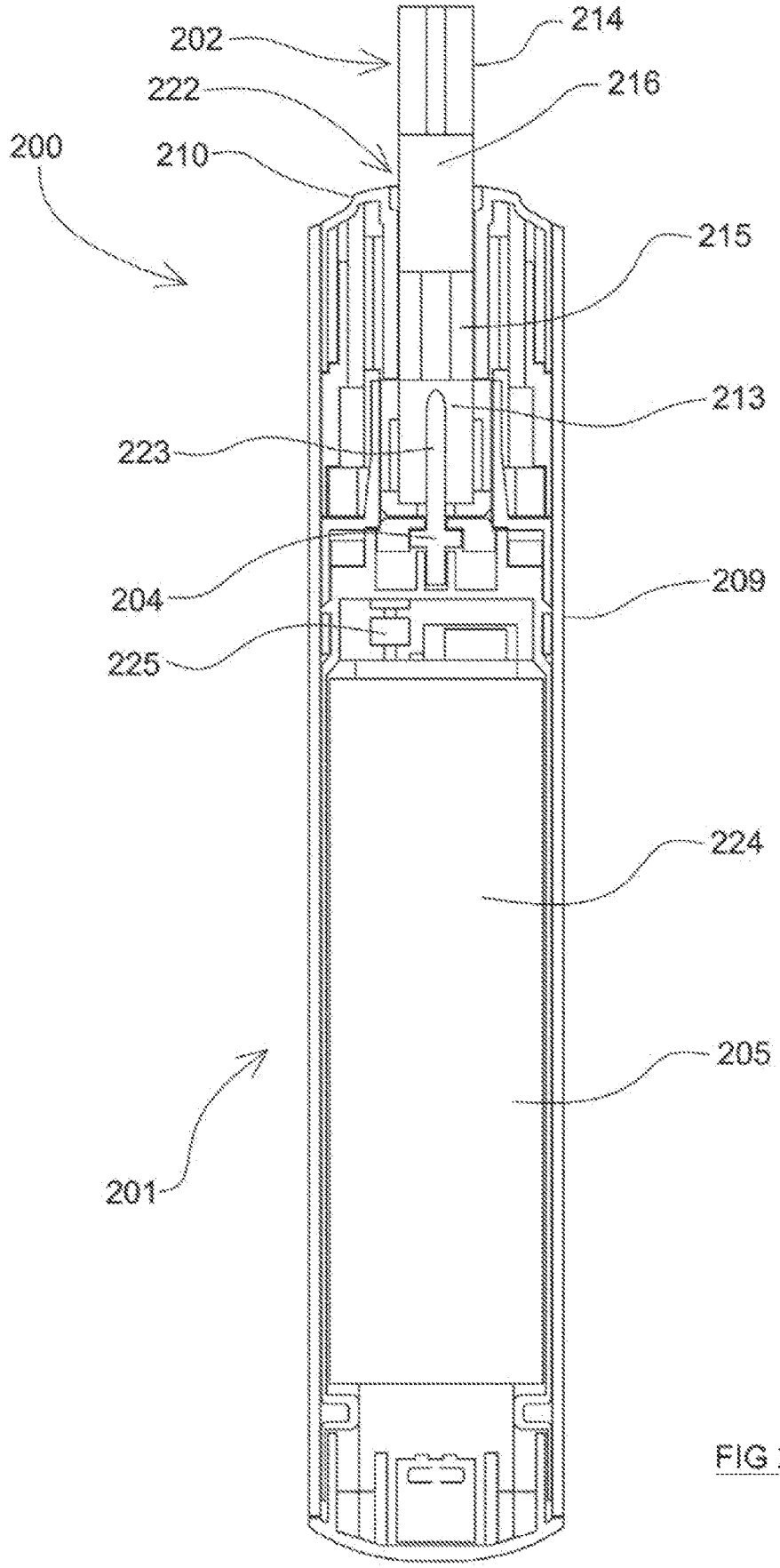
FIG. 2E is a section view of the first embodiment of the substitute smoking system.

FIG. 2E shows a cross section through a central longitudinal plane through the device 201. The device 201 is shown with the consumable 202 engaged therewith.

The device 201 comprises a heater 204 having a heating element 223. The heater 204 forms part of the body 209 of the device 201 and is rigidly mounted to the body 209. In the illustrated embodiment, the heater 204 is a rod heater with a heating element 223 having a circular transverse profile. In other embodiments the heating element may be in the form of a blade heater (e.g., heating element with a rectangular transverse profile) or a tube heater (e.g., heating element with a tubular form).

The heating element 223 of the heater 204 projects from an internal base of the cavity 222 along a longitudinal axis towards the opening 221. As is apparent from the figure, the length (i.e., along the longitudinal axis) of the heating element is less than a depth of the cavity 222. In this way, the heating element 223 does not protrude from or extend beyond the opening 221.

When the consumable 202 is received in the cavity 222 (as is shown in FIG. 2E), the heating element 223 penetrates the aerosol-forming substrate 213 of the consumable 202. In particular, the heating element 223 extends for nearly the entire axial length of the aerosol-forming substrate 213 when inserted therein. Thus, when the heater 204 is activated, heat is transferred radially from an outer circumferential surface the heating element 223 to the aerosol-forming substrate 213.

The device 201 further comprises an electronics cavity 224. A power source, in the form of a rechargeable battery 205 (a lithium-ion battery), is located in electronics cavity 224.

The device 201 includes a connector (i.e., forming part of an IO module of the device 201) in the form of a USB port 206. The connector may alternatively be, for example, a micro-USB port or a USB-C port for examples. The USB port 206 may be used to recharge the rechargeable battery 205.

The device 201 includes a controller (not shown) located in the electronics cavity 224. The controller comprises a microcontroller mounted on a printed circuit board (PCB). The USB port 206 is also connected to the controller 208 (i.e., connected to the PCB and microcontroller).

The controller 208 is configured to control at least one function of the device 202. For example, the controller 208 is configured to control the operation of the heater 204. Such control of the operation of the heater 204 may be accomplished by the controller toggling the electrical connection of the rechargeable battery 205 to the heater 204. For example, the controller 208 is configured to control the heater 204 in response to a user depressing the button 212. Depressing the button 212 may cause the controller to allow a voltage (from the rechargeable battery 205) to be applied to the heater 204 (so as to cause the heating element 223 to be heated).

The controller is also configured to control the LEDs 211 in response to (e.g., a detected) a condition of the device 201 or the consumable 202. For example, the controller may control the LEDs to indicate whether the device 201 is in an on state or an off state (e.g., one or more of the LEDs may be illuminated by the controller when the device is in an on state).

The device 201 comprises a further input means (i.e., in addition to the button 212) in the form of a puff sensor 225. The puff sensor 225 is configured to detect a user drawing (i.e., inhaling) at the downstream end 218 of the consumable 202. The puff sensor 225 may, for example, be in the form of a pressure sensor, flowmeter or a microphone. The puff sensor 225 is operatively connected to the controller 208 in the electronics cavity 224, such that a signal from the puff sensor 225, indicative of a puff state (i.e., drawing or not drawing), forms an input to the controller 208 (and can thus be responded to by the controller 208).

Figure 3B:
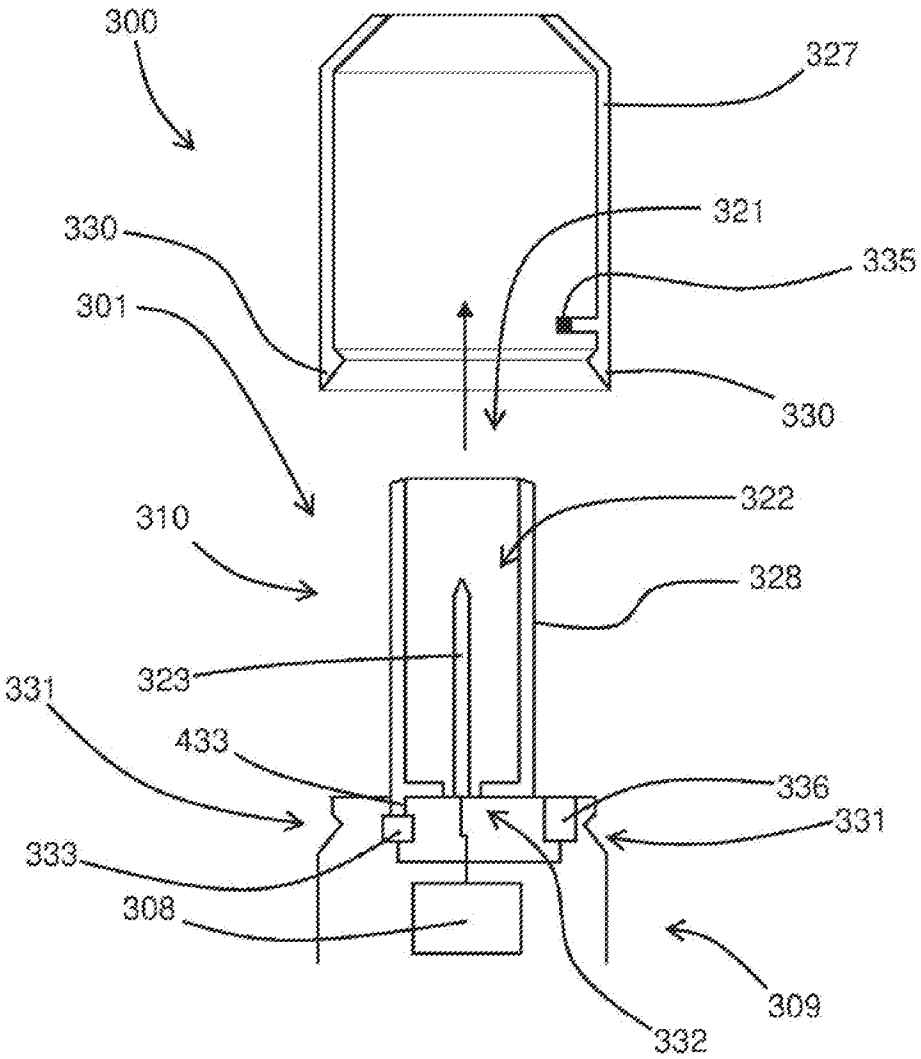
FIG. 3B is a further schematic section view of the second embodiment.
Figure 3A:
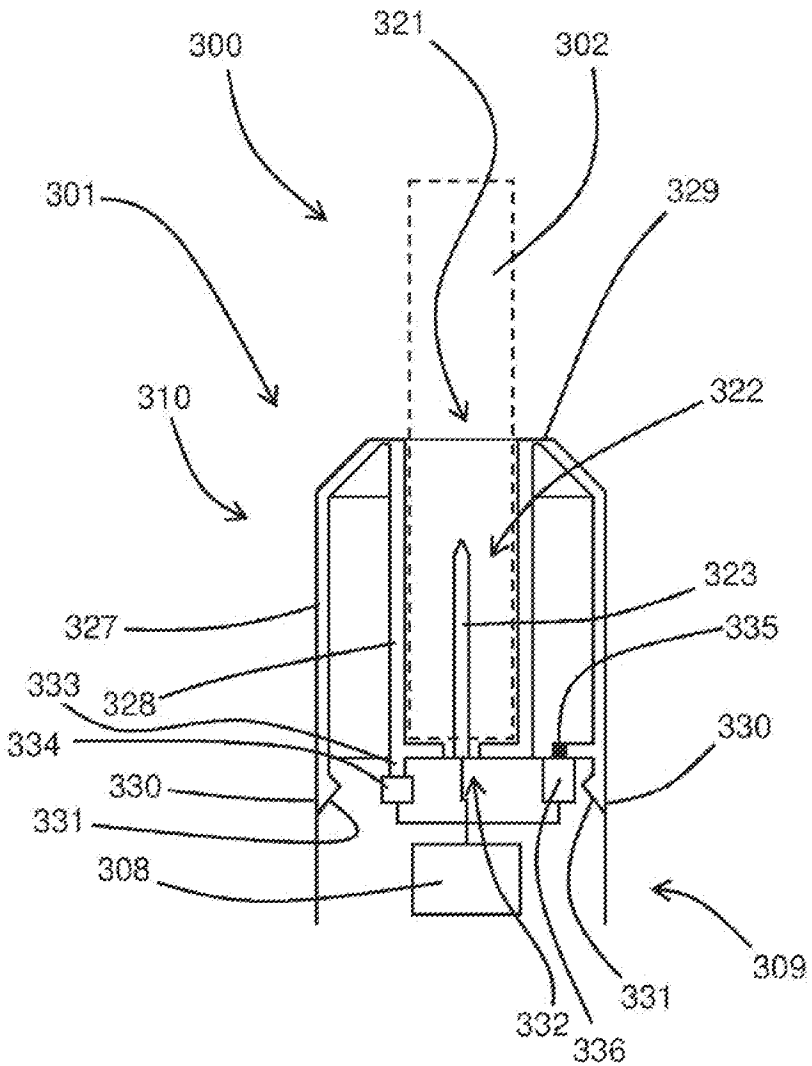
FIG. 3A is a schematic section view of a second embodiment of the substitute smoking system.

FIGS. 3A and 3B provide a further embodiment of the system 300, which illustrates the interaction between the cap 310 and the body 309 (and the heating element 323) of the device 301. It should be appreciated that the features described with respect to this embodiment, could equally form part of the previously described embodiment (as shown in FIG. 2A to 2E).

The cap 310 is generally formed of an outer portion 327 and an inner portion 328 that are connected to one another (at respective upper ends) by a weakened portion 329 of the cap 310, which is in the form of a thinner portion of the wall of the cap 310.

The outer portion 327 extends about the inner portion 328 and, when engaged with the body 309, an outer surface of the outer portion 327 defines an outer surface of the device 301. In other words, it is the outer portion 327 of the cap 310 that is gripped by a user in order to disengage the cap 310 from the body 309. The outer portion 327 comprises ramped protrusions 330. These are located at a lower end of the outer portion 327, that is proximate the body 309 when the cap 310 is engaged therewith. The ramped protrusions 330 are received in, and engaged with, corresponding (and complementary) ramped recesses 331. In this way, the cap 310 is releasably snap-engaged with the body 309.

The inner portion 328 is tubular and extends centrally and downwardly (at least in the orientation illustrated), from the upper opening 321 in the cap 310. Thus, the inner portion 328 defines a cylindrical cavity 322 into which a consumable 302 may be received (i.e., through the opening 321). A lower end of the inner portion 328 comprises an aperture, through which the heating element 323 projects into the cavity 322.

The inner portion 328 also comprises a retaining portion 333 that projects downwardly from its lower end and that is received in a recess formed in the body 309. As will be described further below with reference to FIGS. 4A and 4B, the retaining portion 309 engages with a lock 334 that forms part of the body 309. The lock 334 is moveable, in response to a control signal from the controller 308, between a locked state and an unlocked state. In the locked state, the lock 334 engages the retaining portion 333 and prevents the cap 310 from being disengaged from the body 309. In the unlocked state, the lock 334 is disengaged from the retaining portion 333, such that the cap 310 can be disengaged from the body 309 (with only minor resistance being provided by the engagement of the ramped protrusions 330 and the ramped recesses 331).

The controller 308 is configured to receive a signal indicative of a temperature of the heating element 323 (e.g., via a temperature sensor) and control the lock 334 in response to the temperature. In particular, the controller 308 is configured to compare the measured temperature of the heating element 323 to a predetermined threshold temperature. If the measured temperature exceeds the predetermined threshold temperature, then the controller 308 causes the lock 334 to enter the locked state. This may prevent a user from removing the cap 310, so as to expose the hot heating element 323, which could potentially cause injury to the user. When the measured temperature is less than the predetermined threshold temperature, the controller is configured to cause the lock 334 to enter the unlocked state, so as to allow a user to disengage the cap 310 from the body 309.

The device 301 comprises means for detecting when the cap 310 is removed from the body 309. This is in the form of a hall sensor 336 in the body 309 and a magnet 335 mounted to an inwardly extending projection of the outer portion 327 so as to be adjacent to the all sensor 336 when the cap 310 is engaged with the body 309. When the cap 310 is disengaged from the body 309, the hall sensor 336 no longer detects the presence of the magnet 335. The hall sensor 336 is operatively connected to the controller 308, which is configured to determine that, when the hall sensor 336 provides a signal indicative of the presence of the magnet 335, the cap 310 is engaged with the body 309 and, when the hall sensor 336 provides a signal indicative of the magnet 335 not being present (or provides not signal), the cap 310 is disengaged from the body 309. The controller 308 is further configured to prevent the supply of power to the heating element 323 when the cap 310 is disengaged from the body 309.

As noted above, the inner portion 328 is connected to the outer portion 327 by way of a weakened portion 329 of the cap 310. The weakened portion 329 is specifically configured so as to separate (i.e., break) under a force, imparted by pulling on the cap 310, that is less than the retaining force provided by the lock 334. This means that, if a user attempts (with significant force) to disengage the cap 310 while the lock 334 is in the locked state, the outer portion 327 will separate from the inner portion 328 before the lock 334 releases the retaining portion 333 (e.g., due to lock being damaged).

FIG. 3B illustrates the cap 310 in this separated state. As is apparent from this figure, when the outer portion 327 separates from the inner portion 328, the inner portion 328 remains engaged with the body 309 by way of the lock 334. In this way, the inner portion 328, in which the heating element 323 projects, provides a barrier to the heating element 323 even though the outer portion 327 has been removed. This ensures that even if a user attempts to remove the cap 310 (i.e., with significant force) when the heating element 323 is above the predetermined threshold temperature, they are still protected from being burnt by the heating element 323. Thus, the provision of the weakened portion 329 may improve the safety of the device 301.

The safety of the device 301 may further be improved by the positioning of the hall sensor 336 and the corresponding magnet 335. As previously mentioned, the magnet 335 is mounted to the outer portion 327 rather than the inner portion 328. Thus, when the outer portion 327 is separated from the outer portion 327, the magnet 335 moves away from the hall sensor 336 (positioned on the body 309). As a consequence of this, the hall sensor 336 no longer detects the presence of the magnet 335, and in response the controller 308 prevent further supply of power to the heating element 323 (in this respect, the hall sensor 336 may be considered a tamper sensor). Thus, separation of the outer portion 327 from the inner portion 328 leads to the power supply to the heating element 323 being stopped (and thus subsequent cooling-down of the heating element 323).

Figure 4B:
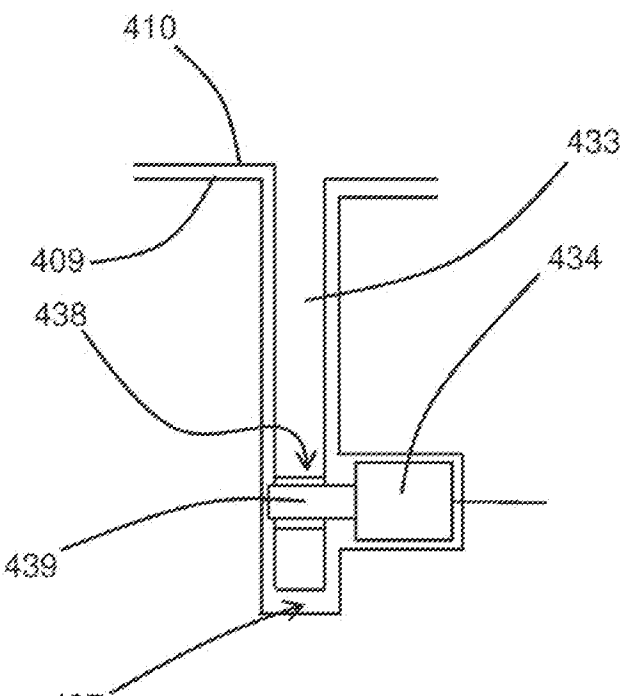
FIG. 4B is a schematic section view of the lock of FIG. 4A in a locked state.
Figure 4A:
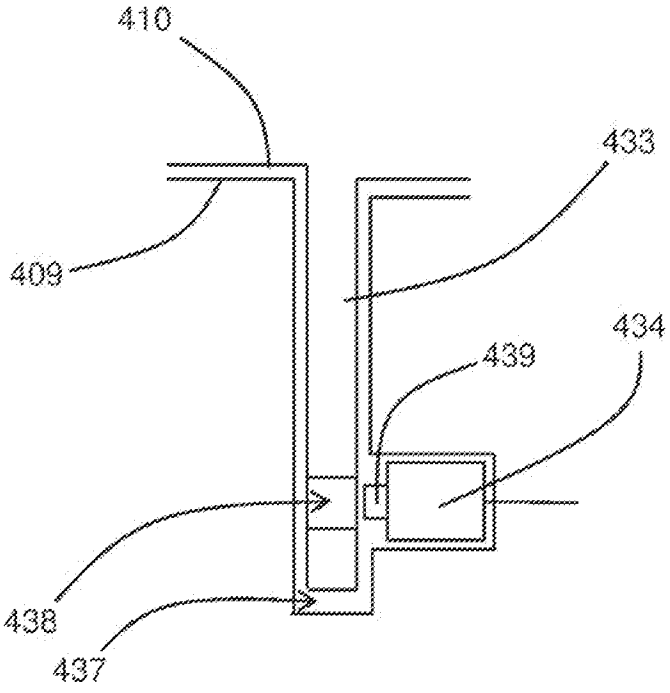
FIG. 4A is a schematic section view of an embodiment of a lock of a substitute smoking system in an unlocked state.

FIGS. 4A and 4B illustrate an exemplary lock 434, which could form part of any of the embodiments previously described. The lock 434 is in the form of a solenoid lock and is disposed in a recess 437 of the body 409 (although it could equally form part the cap 410). The cap 410 comprises a retaining portion 433 that projects downwardly from a lower end of the cap 410 and into the recess 437. The retaining portion 433 comprises a laterally extending aperture 438 formed therein, which aligns with the lock 434 when the retaining portion 433 is received in the recess 437. The lock 434 comprises a pin 439 that is moveable (e.g., in response to a signal from a controller) between a retracted state (shown in FIG. 4A) and an extended state (shown in FIG. 4B).

In the retracted state, the pin 439 is retracted away from the retaining portion 433 so as to allow movement of the retraining portion 433 into and out of the recess 437. This is representative of the lock 434 being in an unlocked state. In the extended state, the pin 439 extends laterally across the recess 437 and through the aperture 438 formed in the retaining portion 433. In this state, the retaining portion 433 is prevented from being moved out of the recess 437 by way of engagement of the pin 439 with the sides of the aperture 438. The retracted state is representative of the lock 434 being in a locked state.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

What is claimed is:

1. A smoking substitute device comprising:

a body;

a heating element projecting from an end of the body;

a cap for engagement with the end of the body, the cap defining a cavity for receipt of the heating element when engaged with the body; and a lock configured to selectively prevent disengagement of the cap from the body based on a condition of the heating element;

wherein the cap comprises an outer portion for gripping by a user, and an inner portion at least partly enclosing the heating element;

wherein the cap is configured such that a force to disengage the cap from the body, when in a locked state, is greater than a force to separate the outer portion from the inner portion; and wherein the cap is configured to be locked to the device via the inner portion.

2. A device according to claim 1 wherein the lock is configured to selectively prevent disengagement of the cap from the body based on a temperature of the heating element.

3. A device according to claim 1 wherein the lock is configured to selectively prevent disengagement of the cap from the body based on whether the heating element is active.

4. A device according to claim 1, wherein the lock is configured to prevent disengagement of the cap from the body when the heating element is in an active state.

5. A device according to claim 1 wherein the lock forms part of the cap or the body and, when in the locked state, engages a retaining portion forming the other of the cap or the body.

6. A device according to claim 5 wherein the retaining portion comprises an aperture in which a portion of the lock is received.

7. A device according to claim 5 wherein the lock comprises at least one of an electro-mechanical device, bimetallic component, shape memory allow wire and expanding wax mechanism.

8. A device according to claim 1 wherein the outer portion is connected to the inner portion by a weakened portion.

9. A device according to claim 8 wherein the weakened portion is configured to break at a force that is less than 80N.

10. A device according to claim 1 wherein the device comprises a tamper sensor for detecting whether the outer portion has been separated from the inner portion.

11. A device according to claim 10 wherein the tamper sensor comprises a hall sensor forming part of the body or the inner portion of the cap, and a magnet disposed on the outer portion.

12. A device according to claim 1 wherein the lock forms part of the body or inner portion and engages the other of the body or inner portion when in the locked state.

13. A device according to claim 1 wherein the lock is configured to provide a retaining force of 80N to 100N.

* * * * *